US010914527B2

(12) United States Patent
Jekerle

(10) Patent No.: US 10,914,527 B2
(45) **Date of Patent: *Feb. 9, 2021**

(54) TUBE BUNDLE HEAT EXCHANGER

(71) Applicant: ARVOS GmbH, Kassel (DE)

(72) Inventor: Jiri Jekerle, Kassel (DE)

(73) Assignee: ARVOS GMBH, Kassel (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/359,995

(22) Filed: Nov. 23, 2016

(65) Prior Publication Data

US 2017/0074593 A1 Mar. 16, 2017

Related U.S. Application Data

(63) Continuation of application No. 12/087,444, filed as application No. PCT/DE2007/000089 on Jan. 19, 2007, now Pat. No. 9,534,850.

(30) Foreign Application Priority Data

Jan. 23, 2006 (DE) ..... 10 2006 003 317

(51) Int. Cl.
*F28F 1/00* (2006.01)
*F28D 7/16* (2006.01)
(Continued)

(52) U.S. Cl.
CPC ..... *F28D 7/106* (2013.01); *F28D 7/16* (2013.01); *F28F 1/003* (2013.01); *F28F 1/006* (2013.01);
(Continued)

(58) Field of Classification Search
CPC ..... F28F 1/006; F28F 9/185; F28F 9/182
See application file for complete search history.

(56) References Cited

U.S. PATENT DOCUMENTS 682,607 A 9/1901 Eck
1,429,149 A 9/1922 Lawrence
(Continued)

FOREIGN PATENT DOCUMENTS

CA 1061653 A 9/1979
CA 2759895 A1 11/2010
(Continued)

OTHER PUBLICATIONS

English Translation of Reason for Refusal for Japanese Patent Application No. 2012-509814, dated Feb. 24, 2014, pp. 1-7.

*Primary Examiner* — Leonard R Leo
(74) *Attorney, Agent, or Firm* — Murtha Cullina LLP

(57) ABSTRACT

A tube bundle heat exchanger has tubes which are held at each side in tube plates or oval-tube collecting-tube plates and are connected to these in each case by means of a weld seam. The connection of the tubes to the inlet-side tube plate or oval-tube collecting-tube plate is formed in each case by means of a conical and/or trumpet-shaped transition piece. The cross section of the transition piece reduces as viewed in the gas flow direction in such a way that the inlet-side end, as viewed in the gas flow direction, of the transition piece is connected in a buttjoint to the tube plate or oval-tube collecting-tube plate. The inner and outer contours of the transition piece and of the welded connection region are formed without gaps and comers to the tube plate or oval tube collecting-tube plate and so as to be straight and/or with a radius, measured from the outer contour, of at least 5 mm.

9 Claims, 5 Drawing Sheets

(51) Int. Cl.
*F28F 9/18* (2006.01)
*F28D 7/10* (2006.01)

(52) U.S. Cl.
CPC ..... *F28F 9/182* (2013.01); *F28F 9/185* (2013.01); *F28F 2275/067* (2013.01)

(56) References Cited

U.S. PATENT DOCUMENTS 1,450,351 A 4/1923 Beran
1,875,188 A 4/1923 Beran
1,477,209 A 12/1923 Cowan
1,524,280 A 1/1925 Bancel
1,894,956 A 1/1933 Kerr
1,915,742 A 6/1933 Mautsch
1,987,798 A 1/1935 Ruppricht
2,023,965 A 12/1935 Lysholm
2,042,017 A 5/1936 Orchard
2,102,936 A 12/1937 Bailey
2,160,677 A 5/1939 Romanoff
2,313,081 A 3/1943 Ljungstrom
2,438,851 A 3/1948 Gates
2,596,642 A 5/1952 Boestad
2,782,009 A 2/1957 Rippingille
2,796,157 A 6/1957 Ginsburg
2,940,736 A 6/1960 Odman
2,983,486 A 5/1961 Rosenberg
3,019,160 A 1/1962 Slezak et al.
3,111,982 A 11/1963 Ulbricht
3,158,527 A 11/1964 Faccin et al.
3,183,963 A 5/1965 Mondt
3,216,494 A 11/1965 Goodman
3,240,266 A 3/1966 Corbet et al.
3,260,511 A 7/1966 Greer
3,262,490 A 7/1966 Olson
3,317,222 A 5/1967 Maretzo
3,372,743 A 3/1968 Pall et al.
3,373,798 A 3/1968 Brummett
3,415,502 A 12/1968 Munters
3,452,814 A 7/1969 Malewicz
3,490,523 A 1/1970 Esmond
3,523,058 A 8/1970 Shick
3,532,157 A 10/1970 Hubble
3,540,529 A 11/1970 Umino et al.
3,542,635 A 11/1970 Parker
3,574,103 A 4/1971 Latkin
3,674,620 A 7/1972 McCarthy et al.
3,726,408 A 4/1973 Gewiss
3,759,323 A 9/1973 Dawson et al.
3,825,412 A 7/1974 Mullender
3,830,684 A 8/1974 Hamon
3,887,664 A 6/1975 Regehr
RE28,534 E 8/1975 Arne
3,901,309 A 8/1975 Thebert
3,940,966 A 3/1976 Deane
3,941,185 A 3/1976 Henning
3,952,077 A 4/1976 Wigley
3,963,810 A 6/1976 Holmberg et al.
4,034,135 A 7/1977 Passmore
4,049,855 A 9/1977 Cogan
4,061,183 A 12/1977 Davis
4,098,722 A 7/1978 Cairns et al.
4,106,558 A * 8/1978 Neveux ..... F28F 13/12 165/174
4,125,149 A 11/1978 Kritzler et al.
4,144,369 A 3/1979 Wass
4,182,402 A 1/1980 Adrian
4,202,449 A 5/1980 Bendt
4,228,847 A 10/1980 Lindahl
4,296,050 A 10/1981 Meier
4,320,073 A 3/1982 Bugler
4,337,287 A 6/1982 Falkenberg
4,343,355 A 8/1982 Goloff et al.
4,344,899 A 8/1982 Monjoie
4,361,426 A 11/1982 Carter et al.
4,363,222 A 12/1982 Cain
4,374,542 A 2/1983 Bradley
4,396,058 A 8/1983 Kurschner et al.
4,409,274 A 10/1983 Chaplin et al.
4,423,772 A 1/1984 Dahlgren
4,449,573 A 5/1984 Pettersson et al.
4,472,473 A 9/1984 Davis et al.
4,501,318 A 2/1985 Hebrank
4,512,389 A 4/1985 Goetschius
4,518,544 A 5/1985 Carter et al.
4,553,458 A 11/1985 Schoonover
4,605,996 A 8/1986 Payne
4,633,936 A 1/1987 Nilsson
4,668,443 A 5/1987 Rye
4,676,934 A 6/1987 Seah
4,689,261 A 8/1987 Ahnstrom
4,744,410 A 5/1988 Groves
4,750,553 A 6/1988 Pohl et al.
4,769,968 A 9/1988 Davis et al.
4,791,773 A 12/1988 Taylor
4,842,920 A 6/1989 Banai et al.
4,847,019 A 7/1989 McNab
4,857,370 A 8/1989 Overbergh et al.
4,858,684 A 8/1989 Brucher et al.
4,862,666 A 9/1989 Kero
4,876,134 A 10/1989 Saitoh et al.
4,906,510 A 3/1990 Todor, Jr. et al.
4,915,165 A 4/1990 Dahlgren et al.
4,930,569 A 6/1990 Harder
4,950,430 A 8/1990 Chen et al.
4,953,629 A 9/1990 Karlsson et al.
4,974,656 A 12/1990 Judkins
4,981,732 A 1/1991 Hoberman
5,031,692 A * 7/1991 Kehrer ..... F28D 7/16 165/134.1
5,085,268 A 3/1992 Nilsson
5,101,892 A 4/1992 Takeuchi et al.
5,150,596 A 9/1992 Hunt et al.
5,308,677 A 5/1994 Renna
5,314,006 A 5/1994 Kaastra et al.
5,314,738 A 5/1994 Ichikawa
5,318,102 A 6/1994 Spokoyny et al.
5,333,482 A 8/1994 Dunlap et al.
5,380,579 A 1/1995 Bianchi
5,413,741 A 5/1995 Buchholz et al.
5,413,872 A 5/1995 Faigle
5,441,793 A 8/1995 Siiess
5,489,463 A 2/1996 Paulson
5,544,703 A 8/1996 Joel et al.
H001621 H 12/1996 Ray
5,598,930 A 2/1997 Leone et al.
5,600,928 A 2/1997 Hess et al.
5,605,655 A 2/1997 Ishihara et al.
5,609,942 A 3/1997 Ray
5,647,741 A 7/1997 Bunya et al.
5,667,875 A 9/1997 Usui
5,747,140 A 5/1998 Heerklotz
5,792,539 A 8/1998 Hunter
5,803,158 A 9/1998 Harder et al.
5,836,379 A 11/1998 Counterman
5,899,261 A 5/1999 Brzytwa et al.
5,979,050 A 11/1999 Counterman et al.
5,983,985 A 11/1999 Counterman et al.
6,019,160 A 2/2000 Chen
6,145,582 A 11/2000 Bolle et al.
6,212,907 B1 4/2001 Billingham et al.
6,251,499 B1 6/2001 Lehman et al.
6,263,570 B1 * 7/2001 Cazacu ..... F28D 1/05383 165/173
6,280,824 B1 8/2001 Insley et al.
6,280,856 B1 8/2001 Anderson et al.
6,478,290 B1 11/2002 Ender et al.
6,497,130 B2 12/2002 Nilsson
6,516,871 B1 2/2003 Brown et al.
6,544,628 B1 4/2003 Aull et al.
6,660,402 B2 12/2003 Tanabe
6,730,008 B1 5/2004 Liang
6,764,532 B1 7/2004 Cheng
7,044,206 B2 5/2006 Sabin et al.
7,117,928 B2 10/2006 Chen

(56) References Cited

U.S. PATENT DOCUMENTS

| | | | |
|---|---|---|---|
| 7,347,351 | B2 | 5/2008 | Slattery |
| 7,555,891 | B2 | 7/2009 | Muller et al. |
| 7,654,067 | B2 | 2/2010 | Wattron |
| 7,938,627 | B2 | 5/2011 | Muller |
| 8,296,946 | B2 | 10/2012 | Wieres et al. |
| 8,323,778 | B2 | 12/2012 | Webb et al. |
| 9,200,853 | B2 | 12/2015 | O'Boyle et al. |
| 9,534,850 | B2 * | 1/2017 | Jekerle ..... F28D 7/106 |
| 2002/0043362 | A1 | 4/2002 | Wilson |
| 2003/0024697 | A1 | 2/2003 | Matsuzaki |
| 2003/0178173 | A1 | 9/2003 | Harting et al. |
| 2005/0274012 | A1 | 12/2005 | Hodgson et al. |
| 2007/0017664 | A1 | 1/2007 | Beamer et al. |
| 2009/0065185 | A1 | 3/2009 | Jekerle |
| 2010/0218927 | A1 | 9/2010 | Cooper et al. |
| 2010/0258284 | A1 | 10/2010 | Krantz |
| 2010/0282437 | A1 | 11/2010 | Birmingham et al. |
| 2012/0305217 | A1 | 12/2012 | Cowburn et al. |
| 2013/0327513 | A1 | 12/2013 | Franz et al. |
| 2014/0054003 | A1 | 2/2014 | O'Boyle et al. |
| 2014/0090822 | A1 | 4/2014 | Seeblad |
| 2015/0144293 | A1 | 5/2015 | Seebald |

FOREIGN PATENT DOCUMENTS

| | | | |
|---|---|---|---|
| CN | 101210780 | A | 7/2008 |
| EP | 0150913 | A2 | 8/1985 |
| EP | 0805331 | A2 | 11/1997 |
| EP | 0945195 | A2 | 9/1999 |
| EP | 1154143 | A1 | 11/2001 |
| EP | 1884732 | A2 | 2/2008 |
| EP | 2427712 | | 11/2010 |
| FR | 775271 | A | 12/1934 |
| FR | 1219505 | A | 5/1960 |
| GB | 177780 | | 2/1923 |
| GB | 992413 | | 5/1965 |
| GB | 1339542 | | 12/1973 |
| GB | 1567239 | | 5/1980 |
| JP | 83112 | | 9/1929 |
| JP | 26-006787 | | 10/1951 |
| JP | S52-000746 | A | 1/1977 |
| JP | S54-085547 | U | 6/1979 |
| JP | S56-075590 | U | 6/1981 |
| JP | S57-154874 | U | 9/1982 |
| JP | 93590 | | 6/1987 |
| JP | 158996 | | 7/1987 |
| JP | 01-273996 | A | 11/1989 |
| JP | 08-101000 | A | 4/1996 |
| JP | 09-280764 | A | 10/1997 |
| JP | 10-328861 | A | 12/1998 |
| JP | 11-294986 | A | 10/1999 |
| JP | 2001-516866 | A | 10/2001 |
| JP | 2003-200223 | A | 7/2003 |
| JP | 2004-093036 | A | 3/2004 |
| KR | 100417321 | B1 | 2/2004 |
| KR | 1020080063271 | | 1/2013 |
| WO | 99014543 | | 3/1999 |
| WO | 2007012874 | A1 | 2/2007 |
| WO | 2010129092 | A1 | 11/2010 |
| WO | 2012000767 | A2 | 1/2012 |

* cited by examiner

TUBE BUNDLE HEAT EXCHANGER

CROSS-REFERENCE TO RELATED APPLICATIONS

This application is a continuation application of co-pending U.S. patent application Ser. No. 12/087,444 filed Jul. 3, 2008, entitled "Tube Bundle Heat Exchanger," that is a U.S. national stage application of International Application No. PCT/DE2007/000089, filed Jan. 19, 2007.

TECHNICAL FIELD

The invention relates to a tube bundle heat exchanger having tubes that are held at each side in tube plates or oval tube collecting tube plates and are connected to these in each case by means of a weld seam, for cooling, by means of a cooling medium surrounding the tubes, a hot gas flow that is directed through the tubes, exhibiting at least one gas inlet chamber, from which the hot gas flow is directed into the individual tubes and which is delimited at one side by the inlet-side tube plate or oval tube collecting tube plate, and at least one gas outlet chamber in which the gas flow directed through the tubes is collected and discharged and which is delimited on one side by the outlet-side tube plate or oval tube collecting tube plate.

BACKGROUND

As a rule, for cooling gases in many materials processing installations, such as, for example, gasification installations, thermal and catalytic splitting installations, steam reforming installations, etc., heat exchangers, in particular, tube bundle heat exchangers (coolers), are used, into which the gases—to be cooled flow through straight tubes and thereby give off the latent heat of the hot gas through the tube wall to the medium surrounding the tubes, in particular, the cooling medium. It is characteristic of such heat exchangers that the gases to be cooled are often under high pressure and at a high temperature and enter the straight tubes of the heat exchanger at high speed. As a result, at the tube inlet or the first section of the tube, a high heat flow density is achieved, which causes both a high temperature as well as high thermal stress in the tubes of the heat exchanger or in the tube plate—tube connection.

In state of the art heat exchangers, the tubes that conduct the gas are welded into the tube plates, whereby the weld seam between tube plate and tube is applied either at the outer or inner wall of the tube plate or inside the tube plate opening. For example, printed document DE 37 15 713 C2 exhibits a welded connection of the tube or tubes with the outer wall of the tube plate or the oval tube collecting tube plate.

The disadvantage of this known design consists in the fact that the gas-facing contour or surface of the transition from the tube to the tube plate or the oval tube collecting tube plate does not exhibit an exactly aerodynamic form. As a rule, the use of an inserted sleeve is undesirable for a number of different reasons, among them a narrowing of the gas-side cross section as well as an inadequate cooling of the sleeve. In addition, a gap can appear on the cooling medium side of the tube plates—tube connection, leading to water-side corrosion, or the tube plates—tube connection can exhibit a corner in which an unwanted stress concentration occurs.

Through document EP 1 154 143 A 1, a cooler has become known in whose heat exchanger tubes, which lie between an inlet-side tube plate and an outlet-side tube plate, an exhaust gas is cooled by cooling water. Through the cooling of the exhaust gas, a condensate that exhibits a corrosive component is created, which causes corrosion at the connection of the particular tube with the outlet-side tube plate.

As a result of this corrosion, a leak of the cooling water occurs at this connection, which leads to damage of the downstream machine. To prevent the leak, it is suggested that the connection of the particular tube with the outlet-side tube plate be designed in such a way that the tube is placed through the tube plate in a conical manner and the conical part of the tube is completely laser welded to the tube plate in order to achieve a deep-reaching welded connection.

SUMMARY

The task of the present invention consists in creating a tube bundle heat exchanger in which the disadvantages cited above can be avoided, and the transition from the tube plate or oval tube collecting tube plate to the tubes on the gas side exhibits a contour that is favorable to flow and no disturbing elements are present on the cooling medium side and the gas side.

The solution provides that the connection of the tubes with the inlet-side tube plate or oval header tube sheet is formed in each case by means of a conical and/or trumpet-shaped transition piece whose cross section reduces, as viewed in the gas flow direction, in such a way that the inlet-side end, as viewed in the gas flow direction, of the transition piece is connected in the manner of a butt joint to the tube plate or oval header tube sheet, and the inner and outer contours of the transition piece and of the welded connection region are formed without gaps and corners to the tube plate or oval header tube sheet, and so as to be straight and/or with a radius, measured from the outer contour, that is equal to or greater than 5 mm.

Through the solution according to the invention, a tube bundle heat exchanger is created that exhibits the following advantages:

By avoiding the protruding corners and gaps at the connecting location between the tubes and the tube plate or the oval tube collecting tube plate, first, turbulence of the gas and the cooling medium is prevented, and second, corrosion is eliminated, The transition from the tube plate or the oval tube collecting tube plate to the tubes is designed aerodynamically, so that the entry of the gas into the tubes runs to the greatest extent turbulence-free, and temperature peaks in the inlet region can be reduced.

In an advantageous further development, the length Lu of the transition piece is at least 1.5 times the inside diameter di of the heat exchanger tube and/or the inside diameter Di of the transition piece at its inlet is at least 1.2 times the inside diameter di of the heat exchanger tube in order to achieve an optimized aerodynamic transition of the tube plate or the oval tube collecting tube plate to the particular heat exchanger tubes.

It is useful to mechanically widen the transition piece at the inlet-side end of the tube, as viewed in the gas flow direction. Through this measure, only one part—the tube—is fabricated, and the work process for the manufacture of the transition piece according to the invention can be simplified and shortened.

In an advantageous further development of the invention, the transition piece is formed from a separate tube part, and the outlet-side end, as viewed in the gas flow direction, of the transition piece is connected in the manner of a butt joint with the tube by means of weld seam. Through the use of a separate tube part, even transition pieces that are complicated in their form (for example, various differing transition radii) can be manufactured in a substantially simpler and less expensive way. In this further development of the invention, it is useful to form the inner and outer contours of the welded connection region between the transition piece and the tube without gaps and corners and so as to be straight and/or with a radius equal to or greater than 5 mm. Through this measure, an aerodynamic form is achieved at the inlet of the gas into the tube.

In an especially advantageous manner, the inner and outer contours of the transition piece and of the welded connection region to the tube plate or the oval tube collecting tube plate and to the tube are formed without gaps and corners, and so as to be straight and/or with a radius equal to or greater than 2 mm.

The tube part that is used as the transition piece is usefully formed as a forged piece.

BRIEF DESCRIPTION OF THE DRAWINGS

In the following, embodiments of the invention are explained in more detail with the aid of the drawing and the description.

The following are shown.

DETAILED DESCRIPTION

Figure 1:
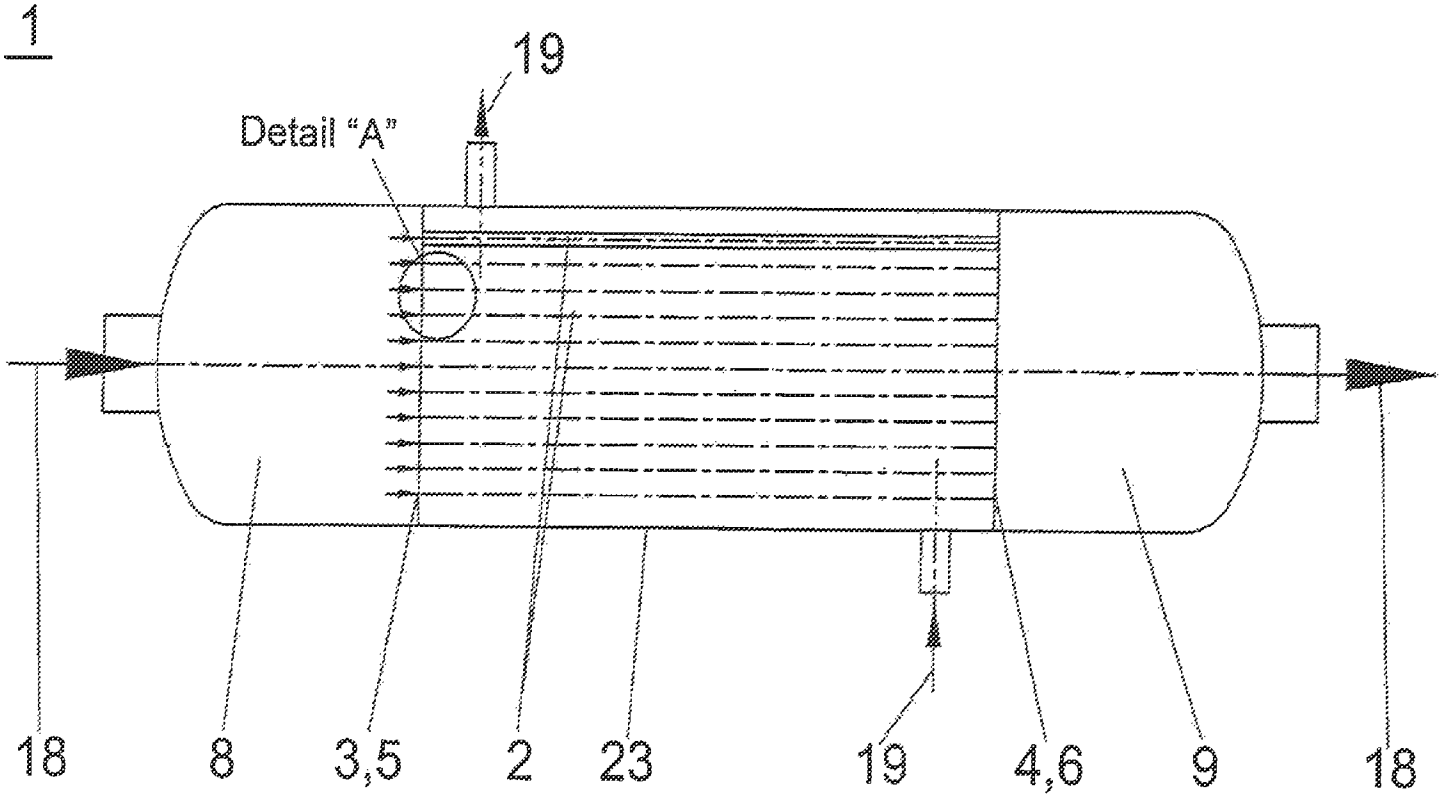
FIG. 1 is a longitudinal section through a tube bundle heat exchanger.

FIG. 1 shows a tube bundle heat exchanger 1 represented schematically in longitudinal section. Tube bundle heat exchangers 1 of this type are needed in many material processing installations, such as, for example, gasification installations, thermal and catalytic splitting installations, steam reforming installations, etc., in which a process gas, an exhaust gas or something similar is produced. As a rule, the tube bundle heat exchanger 1 is used for cooling the hot gas 18 mentioned above, which is introduced into the gas inlet chamber 8 of the heat exchanger 1 via a line, not shown, and is directed from here through a multiplicity of straight tubes 2, subsequently collected in the gas outlet chamber 9 of the heat exchanger 1 and discharged from the heat exchanger 1 by means of a line, not shown. In that regard, the tubes 2, by means of which an indirect heat exchange with a cooling medium 19 surrounding the tubes 2 takes place, are arranged at a distance from each other between two tube plates 3, 4 or oval tube collecting tube plates 5, 6 and are connected with the latter in fixed and gas-tight usually welded fashion.

In order to keep the thermal stresses taking place at the entry of the hot gas 18 from the gas inlet chamber 8 into the particular heat exchanger tubes 2 at the inlet-side, as viewed in the gas flow direction, tube plates 3, 5 and the inlet-side ends 16 of the tubes 2 as small as possible, according to the invention the connection of the tubes 2 with the inlet-side tube plate 3 (see FIGS. 2 through 4) or oval tube collecting tube plate 5 (see FIG. 5) is formed in each case by means of a conical and/or trumpet-shaped transition piece 10 whose cross section decreases as viewed in the gas flow direction (see arrow). Moreover, the inlet-side end 16, as viewed in the gas flow direction, of the transition piece 10 is connected in the manner of a butt joint to the tube plate 3 or oval tube collecting tube plate 5, and the inner and outer contours 11, 12 of the transition piece 10 and of the welded connection region 13 are formed without gaps and corners to the tube plate 3 or oval tube collecting tube plate 5, and so as to be straight and/or with a radius, measured from the outer contour 12, of at least 5 mm.

This means that the inventive design of the transition from the tube plate 3 or the oval tube collecting tube plate 5 to the tube 2 creates an aerodynamic contour 11, 12 on both the gas-contacted and cooling medium-contacted side of the tube 2, of the transition piece 10 and of the tube plate 3 or oval tube collecting tube plate 5, which does not exhibit a gap, a corner or an angular transition anywhere. This means that according to the invention, all of the transitions, including that of the welded transition region 13 to the inner or outer contour 11, 12, are either straight or flat, and/or are designed with a radius.

Figure 2:
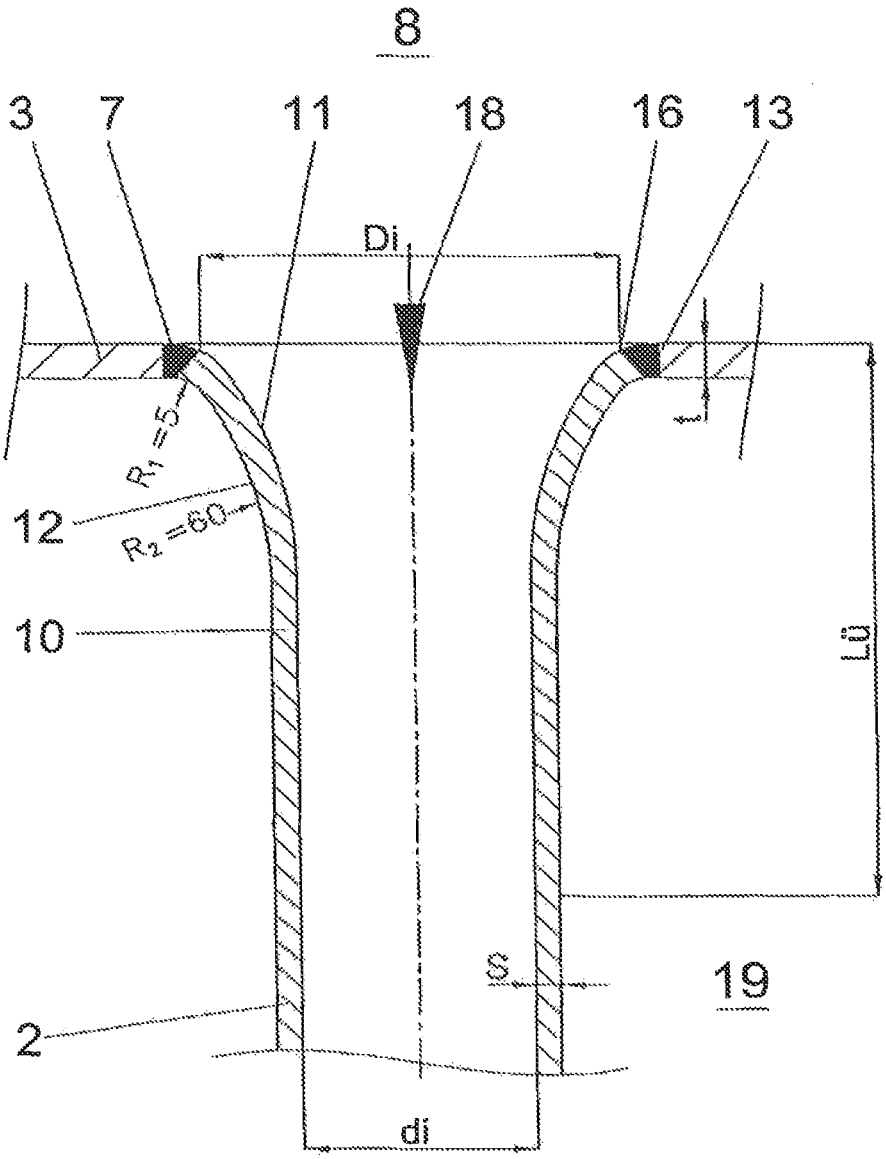
FIG. 2 is a detail section of the transition from the tube plate to the tube in accordance with detail "A" from FIG. 1.
Figure 3:
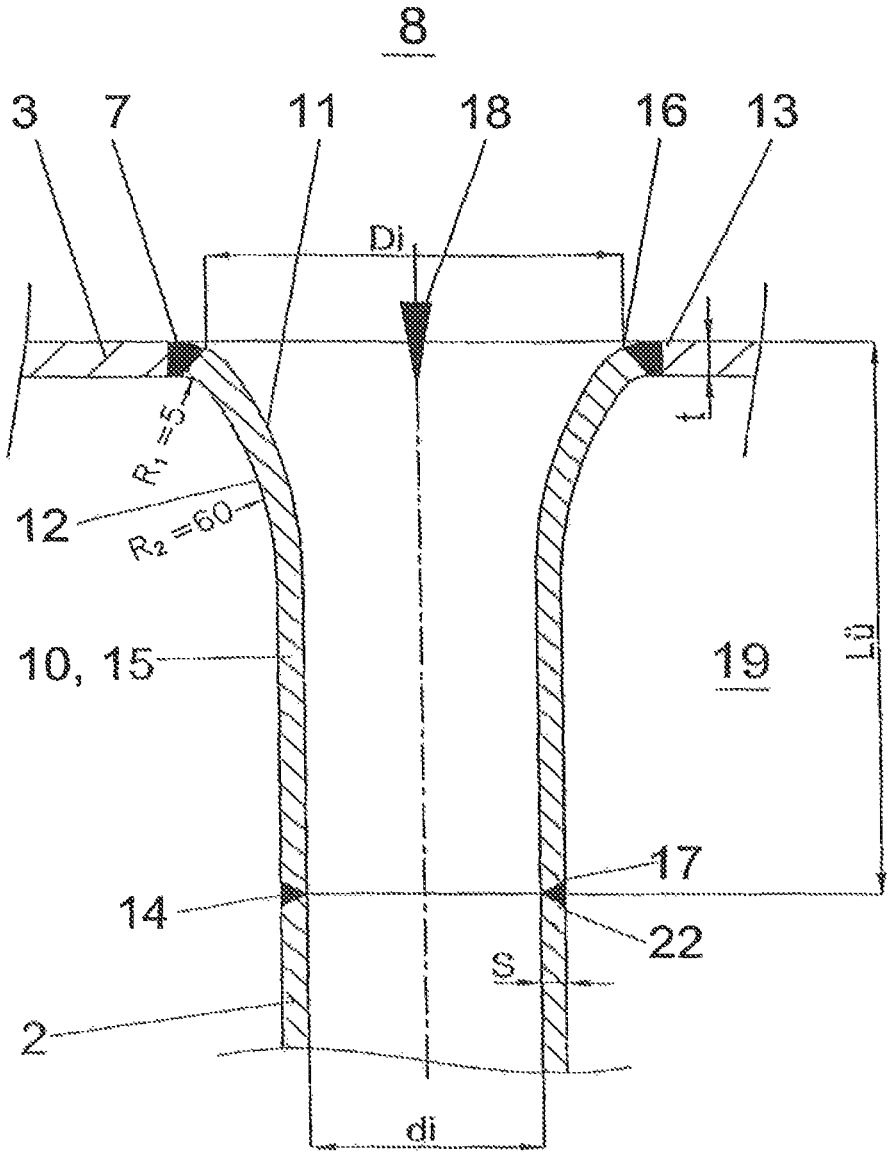
FIG. 3 is an alternative design of FIG. 2.
Figure 4:
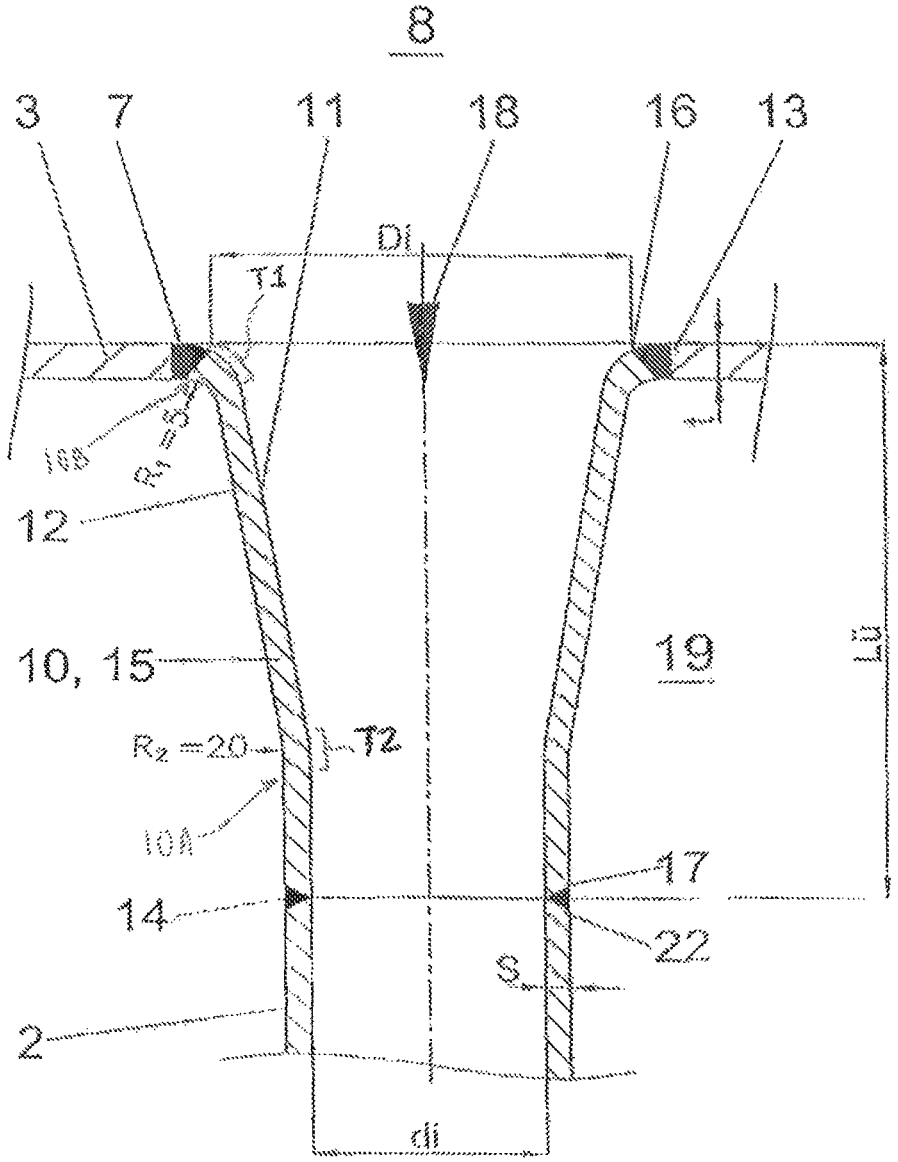
FIG. 4 is an alternative design of FIG. 2.
Figure 5:
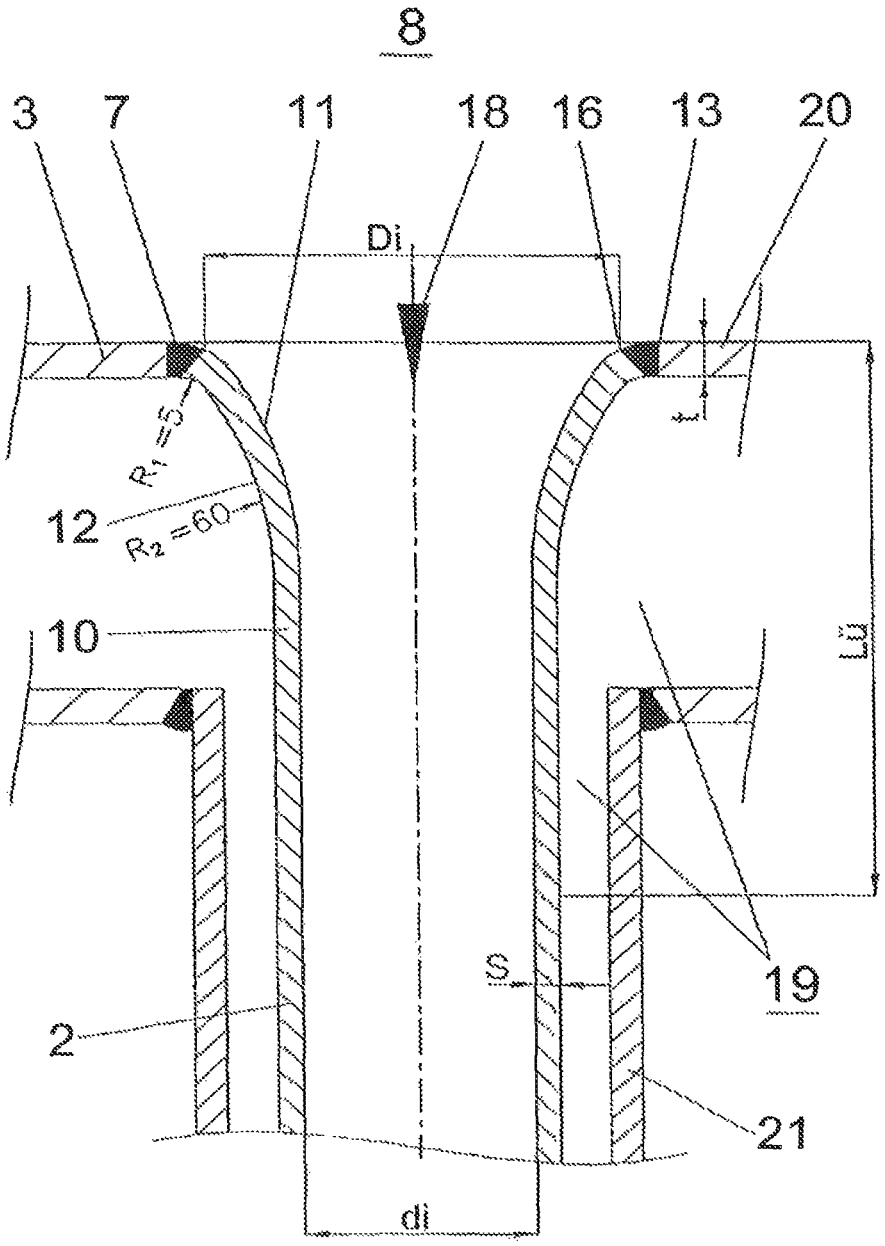
FIG. 5 is a detail section of the transition of an oval tube collecting tube plate to a tube.

According to FIGS. 2 and 5, the transition piece 10 is the widened, e.g. mechanically, from the tube 2 at diameter di transitioning to diameter Di at the inlet end 16 of tube 2. In this design, only weld seam 7 is needed between the tube 2 and the tube plate 3 or 5, which forms the welded connection region 13 between the tube 2 and the tube plate 3, 5. FIGS. 3 and 4 show a transition piece 10 that consists of a separate tube part 15 and is as a rule easier to manufacture, since the tube part 15 is significantly shorter than the complete tube 2 and is thus easier to process as well. For the head-side connection of the outlet-side end 17, as viewed in the gas flow direction, of the tube part 15, an additional weld seam 22 is needed, which forms the welded connection region 14 between the tube 2 and the tube part 15. This welded connection region 14 is advantageously made either straight or flat and/or with a radius both on the inside as well as on the outside contour 11, 12, i.e., the region 14 is made without corners and gaps.

The transition pieces 10 according to FIGS. 2 through 5 exhibit on their inlet-side end 16, relative to the outer contour 12 of the transition pieces 10, a radius R1 of 5 mm, for example. According to FIGS. 2, 3 and 5, adjoining that is an additional radius R2 of 60 mm, for example. By contrast, in the case of the transition piece 10 according to FIG. 4, adjoining the first radius is a conical contraction (e.g., conical transition piece 10) having an inlet-side transition segment T1 with a first inner contour and a first outer contour and an outlet-side transition segment T2 with a second inner contour and a second outer contour. The first outer contour having a radius of curvature of 20 mm, for example, at the inlet-side transition segment T1. The second outer contour having a radius of curvature of at least 5 mm at the outlet-side transition segment T2. As shown in FIG. 4 the tubes 2 include a conical transition piece 10 expanding outwardly from a first end 10A to a second end 10B thereof. The first end 10A extends from the inlet-side transition segment T1 of a respective one of the plurality of tubes 15. The second end 10B terminates at the outlet-side transition segment T2 of the respective one the tubes 2 at the inlet end 16 at the respective opening of the inlet-side tube plate 3.

The inside contour 11 of the transition pieces 10 according to FIGS. 2 and 5 then exhibits corresponding radii that are greater by the wall thickness s of the transition piece 10. If the wall thickness t of the tube plate 3, 5 does not correspond to the wall thickness s of the tube 2, then according to the invention the transition between the two wall thickness s and t within the welded connection region 13 is designed according to the invention either straight or flat and/or with a radius. A wall thickness t of the tube plates 3, 5 that differs from the wall thickness s of the tube 2 can be compensated according to FIGS. 3 and 4 with a transition piece 10 designed. as a tube part 15, in that the particular wall thickness at the tube ends of the tube part 15 are adjusted to the wall thicknesses t and s of the tube plate 3, 5 as well as of the tube 2. This means that, viewed in the gas flow direction, inside the tube piece 15 the wall thickness t continuously decreases or increases to the wall thickness s. In that regard, the tube part 15 can advantageously be designed as a forged part.

The length LO of the transition piece 10 is advantageously 1.5 times the inside diameter di of the tube 2 and the inside diameter Di of the transition piece 10 directly at the entry into the transition piece 10 is advantageously 1.2 times the inside diameter di of the tube 2.

By way of example, FIG. 4 shows in place of the trumpet-shaped transition piece 10 a conical transition piece 10, which is also formed from a separate tube part 15. Here again, the tube part 15 is connected with the tube plate 3 and the tube 2 by two weld seams 7, 22.

FIG. 5 shows a tube bundle heat exchanger 1 with double tubes 2, 21 in which the cooling medium 19 circulates in the annular cross section between the inner tube 2 and the outer tube 21. Because of the outer tubes 21 that carry the cooling medium 19, the heat exchanger outer jacket 23, which is shown in FIG. 1 and which would otherwise be required, can be dispensed with. While in the case of the heat exchanger 1 shown in FIG. 1, the cooling medium 19 is fed to and discharged from the space inside the outer jacket 23 and the tube plates 3, 5 and 4, 6, according to FIG. 5 the cooling medium 19 is fed and discharged by means of oval tube collector 20. In this case, the connection of the transition piece 10 according to the invention takes place with the oval tube collecting tube plate 5.

Water that is partially or completely vaporized by the addition of heat can be used as the cooling medium 19.

LIST OF REFERENCE SYMBOLS

1 Tube bundle heat exchanger
2 Tube
3 Tube plate, inlet side.
4 Tube plate, outlet side
5 Oval tube collecting tube plate, inlet side
6 Oval tube collecting tube plate, outlet side
7 Weld seam
8 Gas inlet chamber
9 Gas outlet chamber
10 Transition piece
10A outlet-side end
10B inlet-side end
T1 inlet-side transition segment
T2 outlet-side transition segment
11 Inside contour
12 Outside contour
13 Welded connection region
14 Welded connection region
15 Tube part
16 Inlet-side end of the transition piece or of the tube
17 Outlet-side end of the transition piece or of the tube
18 Gas
19 Cooling medium
20 Oval tube collector
21 Outer tube
22 Weld seam
23 Jacket

What is claimed is:

1. A tube bundle heat exchanger comprising:

a gas inlet chamber adapted to receive a gas into the heat exchanger;

a gas outlet chamber adapted to emit the gas from the heat exchanger;

an inlet-side tube plate disposed proximate to the gas inlet chamber, the inlet-side tube plate having a substantially flat axially outward facing surface, the inlet-side tube plate having a plurality of inlet-openings that are coplanar with the axially outward facing surface;

an outlet-side tube plate disposed proximate to the gas outlet chamber, the outlet-side tube plate having a plurality of outlet-openings; and a plurality of tubes, each of the plurality of tubes having an inlet end with a first circular cross sectional flow area having a first inside diameter and each of the plurality of tubes having an outlet end, each of the inlet-openings of the inlet-side tube plate being circular;

wherein the outlet end of each of the plurality of tubes is welded to a respective outlet-opening of the outlet-side tube plate;

a transition piece attached to at least one of the plurality of tubes, the transition piece comprising;

(i) a tubular segment having a first circular cross sectional flow opening and the first inside diameter, the tubular segment extending along a longitudinal axis of the transition piece, the tubular segment having an outlet-side end at the first cross sectional flow opening, the outlet-side end being welded to the inlet end of a respective one of the plurality of tubes;

(ii) an arcuate outlet-side transition segment extending from the tubular segment towards a respective one of the inlet-openings of the inlet-side tube plate, the outlet-side transition segment having an axially extending arcuate outlet-side inside surface and an axially extending arcuate outlet-side exterior surface, the axially extending arcuate outlet-side exterior surface having an outlet-side radius of curvature;

(iii) a conical transition segment extending from the arcuate outlet-side transition segment and expanding symmetrically away from the longitudinal axis and outwardly toward a respective one of the inlet-openings of the inlet-side tube plate;

(iv) an inlet-side transition segment having an axially extending arcuate inlet-side inside surface and an axially extending arcuate inlet-side exterior surface, the axially extending arcuate inlet-side exterior surface having an inlet-side radius of curvature, the arcuate inlet-side transition segment extending a length from the conical transition segment toward and welded to a respective one of the inlet-openings and the arcuate inlet-side transition segment having circular cross sections entirely along the length thereof and having a second circular cross sectional flow opening that is substantially coplanar with the axially outward facing surface the inlet-side tube plate and the second circular cross sectional flow opening having a second inside diameter that is greater than the first inside diameter of the first cross sectional flow opening; and wherein each of the plurality of tubes and the transition piece provide fluid communication of the gas between the gas inlet chamber and the gas outlet chamber, wherein the axially extending arcuate inlet-side inside surface and the axially extending arcuate inlet-side exterior surface are formed without gaps or corners to the inlet-side tube plate, and further wherein the outlet-side radius of curvature is 20 mm and the inlet-side radius of curvature is 5 mm.

2. The tube bundle heat exchanger of claim 1, wherein the arcuate outlet-side transition segment further comprises an outlet-side inner contour.

3. The tube bundle heat exchanger of claim 1, wherein the inlet-side inner contour and the inlet-side outer contour being formed without gaps or corners to the inlet-side tube plate.

4. The tube bundle heat exchanger of claim 1, wherein the inlet-side transition segment is welded to a respective one of the inlet-openings without gaps and corners.

5. The tube bundle heat exchanger of claim 1, wherein the transition piece has a length that is 1.5 times the second inside diameter.

6. The tube bundle heat exchanger of claim 1, wherein the second inside diameter is at least 1.2 times the first inside diameter.

7. A tube bundle heat exchanger comprising:

a gas inlet chamber adapted to receive a gas into the heat exchanger;

a gas outlet chamber adapted to emit the gas from the heat exchanger;

an inlet-side tube plate disposed proximate to the gas inlet chamber, the inlet-side tube plate having a substantially flat axially outward facing surface, the inlet-side tube plate having a plurality of inlet-openings that are coplanar with the axially outward facing surface;

an outlet-side tube plate disposed proximate to the gas outlet chamber, the outlet-side tube plate having a plurality of outlet-openings; and a plurality of tubes, each of the plurality of tubes having an inlet end with a first circular cross sectional flow opening having a first inside diameter and each of the plurality of tubes having an outlet end, each of the inlet-openings of the inlet-side tube plate being circular;

wherein the outlet end of each of the plurality of tubes is welded to a respective outlet-opening of the outlet-side tube plate;

a transition piece attached to at least one of the plurality of tubes, the transition piece comprising:

(i) an arcuate outlet-side transition segment welded to the inlet end of a respective one of the plurality of tubes and extending toward a respective one of the inlet-openings of the inlet-side tube plate, the arcuate outlet-side transition segment having an axially extending arcuate outlet-side inside surface and an axially extending arcuate outlet-side exterior surface, the axially extending arcuate outlet-side exterior surface having an outlet-side radius of curvature;

(ii) a conical transition segment extending from the outlet-side transition segment and toward a respective one of the inlet-openings of the inlet-side tube plate;

(iii) an inlet-side transition segment having an axially extending arcuate inlet-side inside surface and an axially extending arcuate inlet-side exterior surface, the axially extending inlet-side exterior surface having an inlet-side radius of curvature, the arcuate inlet-side transition segment extending a length from the conical transition segment toward and welded to a respective one of the inlet-openings and the arcuate inlet-side transition segment having circular cross sections entirely along the length thereof and having a second circular cross sectional flow opening that is substantially coplanar with the axially outward facing surface of the inlet-side tube plate and the second circular cross sectional flow opening having a second inside diameter that is greater than the first inside diameter of the first cross sectional flow area, and outlet-side radius of curvature being greater than the first inlet-side radius of curvature; and wherein each of the plurality of tubes and the transition piece provide fluid communication of the gas between the gas inlet chamber and the gas outlet chamber, wherein the axially extending arcuate inlet-side inside surface and the axially extending arcuate inlet-side exterior surface are formed without gaps or corners to the inlet-side tube plate, and further wherein the outlet-side radius of curvature is 20 mm and the inlet-side radius of curvature is 5 mm.

8. A method for using the tube bundle heat exchanger according to claim 7, comprising:

introducing the gas to the conical transition segment from the inlet-side tube plate.

9. The tube bundle heat exchanger of claim 7, wherein the inlet-side transition segment is welded to a respective one of the inlet-openings without gaps and corners.

* * * * *